US010470268B2

(12) United States Patent
Yang et al.

(10) Patent No.: US 10,470,268 B2
(45) Date of Patent: Nov. 5, 2019

(54) LIGHT EMITTING DIODE DRIVING CIRCUIT AND LIGHT EMITTING DIODE LIGHTING DEVICE

(71) Applicant: LEDVANCE GmbH, Garching (DE)

(72) Inventors: Xusheng Yang, Shenzhen (CN); Kaichun Huang, Shenzhen (CN)

(73) Assignee: LEDVANCE GMBH, Garching Bei München (DE)

( * ) Notice: Subject to any disclaimer, the term of this patent is extended or adjusted under 35 U.S.C. 154(b) by 0 days.

(21) Appl. No.: 15/567,208

(22) PCT Filed: Mar. 15, 2016

(86) PCT No.: PCT/EP2016/055519
§ 371 (c)(1),
(2) Date: Oct. 17, 2017

(87) PCT Pub. No.: WO2016/165893
PCT Pub. Date: Oct. 20, 2016

(65) Prior Publication Data

US 2018/0153014 A1 May 31, 2018

(30) Foreign Application Priority Data

Apr. 17, 2015 (CN) ..... 2015 1 0184396

(51) Int. Cl.
*H05B 33/08* (2006.01)

(52) U.S. Cl.
CPC ..... *H05B 33/0854* (2013.01); *H05B 33/0815* (2013.01)

(58) Field of Classification Search
None
See application file for complete search history.

(56) References Cited

U.S. PATENT DOCUMENTS

2007/0217230 A1* 9/2007 Charles ..... H02J 1/102 363/20
2013/0342119 A1* 12/2013 Malboeuf Joset ..... H05B 33/0809 315/193
2015/0070946 A1* 3/2015 Reed ..... H05B 33/0815 363/21.17

(Continued)

FOREIGN PATENT DOCUMENTS

EP 2273466 A1 1/2011
WO 2014072847 A1 5/2014

*Primary Examiner* — Jimmy T Vu
*Assistant Examiner* — Laura Yesildag
(74) *Attorney, Agent, or Firm* — Hayes Soloway PC

(57) ABSTRACT

The LED driving circuit includes: a detecting circuit that detects whether an input current of the driving circuit is low or high frequency; a first stage converter that converts the input of the driving circuit to provide a DC power suitable for the LED; a first feedback loop that is activated by a low frequency current, to convert a current from a LED load to a feedback voltage and feed it back to the first stage converter, wherein in the first feedback loop, the feedback voltage changes as a function of the current of the LED load; and a second feedback loop that is activated by high frequency current, to convert the current from the LED load to the feedback voltage and feed it back to the first stage converter, wherein in the second feedback loop, the feedback voltage changes as a function of the current of the LED load.

20 Claims, 9 Drawing Sheets

(56) References Cited

U.S. PATENT DOCUMENTS

2015/0223303 A1* 8/2015 Hsia ..... H05B 33/0884
315/121
2015/0312983 A1* 10/2015 Hu ..... F21K 9/64
315/186

* cited by examiner

LIGHT EMITTING DIODE DRIVING CIRCUIT AND LIGHT EMITTING DIODE LIGHTING DEVICE

CROSS-REFERENCE TO RELATED APPLICATION AND PRIORITY

This patent application is a U.S. National Stage of International Patent Application No. PCT/EP2016/055519 filed on Mar. 15, 2016, which claims priority from Chinese Patent Application No. 201510184396.4 filed on Apr. 17, 2015. Each of these patent applications is herein incorporated by reference in its entirety.

FIELD OF THE INVENTION

The present invention relates to the field of lighting driving, and particularly to a light emitting diode driving circuit and a light emitting diode lighting device, which are compatible with AC mains, a conventional ballast (CCG) and an electronic ballast (ECG).

BACKGROUND OF THE INVENTION

With the rise and continuous improvement of the solid state lighting technology, due to properties such as high efficiency, energy saving, long lifetime and environment friendliness, the light emitting diode (LED) has become a preferable solution in the lighting engineering nowadays, and has been gradually applied in lighting products. A key factor which encourages people to focus on the LED lighting technology is that it significantly reduces the energy consumption and can realize long-term reliable operation.

The LED tube is drived by a DC power, and thus regardless of powering using the AC mains, the CCG or the ECG, a power adapter, that is, a LED driving circuit, is required to be added between the AC mains, the CCG or the ECG and the LED. The function of the LED driving circuit is to convert the supplied power to the DC power suitable for the LED.

The AC mains and the CCG can be approximately considered as low frequency constant voltage sources (a RMS value of an output voltage thereof is constant), while the ECG can be approximately considered as a high frequency constant current source (a RMS value of an output current thereof is constant). Since the ECG has different current and voltage output characteristics from the AC mains and the CCG, more and more attention has been paid to a design of a LED driving circuit which is compatible with the AC mains, the CCG and the ECG.

Currently, in the prior art, a driving circuit having two-stage converter of a boost type power factor correction (PFC) converter and a buck converter is used so as to be compatible with the AC mains, the CCG and the ECG, but the driving circuit using two-stage converter has a low working efficiency and a high cost. In this case, a design of a driving circuit having a single stage converter so as to be compatible with the AC mains, the CCG and the ECG has become a hotspot of interest.

SUMMARY OF THE INVENTION

An object of the invention is to provide a light emitting diode driving circuit having a single stage converter and being compatible with the AC mains, the CCG and the ECG and a light emitting diode lighting device including the driving circuit.

An aspect of the invention relates to a light emitting diode (LED) driving circuit, and the driving circuit may include: a detecting circuit that may detect whether an input of the driving circuit is a low frequency current or a high frequency current; a first stage converter that may converts the input of the driving circuit so as to provide a DC power suitable for the LED; a first feedback loop that may be activated when the detecting circuit detects that the input of the driving circuit is the low frequency current, to convert a current from a LED load to a feedback voltage and feed it back to the first stage converter, wherein in the first feedback loop, when the current of the LED load is larger than a target value, the feedback voltage decreases, and when the current of the LED load is smaller than the target value, the feedback voltage increases; and a second feedback loop that may be activated when the detecting circuit detects that the input of the driving circuit is the high frequency current, to convert the current from the LED load to a feedback voltage and feed it back to the first stage converter, wherein in the second feedback loop, when the current of the LED load is larger than the target value, the feedback voltage increases, and when the current of the LED load is smaller than the target value, the feedback voltage decreases.

According to an embodiment of the invention, the low frequency current may comprise output current of direct AC mains or AC mains in series with a CCG, and the high frequency current may comprise output current of an ECG.

According to an embodiment of the invention, the first stage converter may include: a controller that may receive the feedback voltage of the first feedback loop or the second feedback loop as an input voltage; and a converter switch a turn-on time of which is controlled by the input voltage of the controller, wherein the larger the input voltage of the controller is, the larger the turn-on time of the converter switch is.

According to an embodiment of the invention, the detecting circuit may include a coupling transformer which may be configured to have a predetermined inductance so that when the low frequency current flows through a primary coil of the coupling transformer, an inductive voltage generated by a secondary coil of the coupling transformer is an alternating voltage of 0V and when the high frequency current flows through the primary coil of the coupling transformer, the inductive voltage generated by the secondary coil of the coupling transformer is an alternating voltage of larger than 0V.

According to an embodiment of the invention, the first feedback loop may include an inverting amplifier.

According to an embodiment of the invention, the second feedback loop may include a non-inverting amplifier.

According to an embodiment of the invention, the first stage converter may be any one of a buck converter, a buck-boost converter and a boost converter.

According to an embodiment of the invention, the driving circuit may further include a fast recovery rectifier that may convert the input of the driving circuit from the AC power to the DC power before the first stage converter converts the input of the driving circuit.

According to an embodiment of the invention, the driving circuit may further include a selecting circuit that may select the first feedback loop or the second feedback loop to be activated based on a detection result of the detecting circuit.

According to an embodiment of the invention, the driving circuit may further include a second stage converter, which may be a buck converter connected between the first stage converter and the LED load, that may reduce an output voltage of the first stage converter, smooth ripple of the output voltage and output the processed voltage to the LED load.

An aspect of the invention relates to a light emitting diode lighting device including the light emitting diode driving circuit according to the invention.

The LED driving circuit and the LED lighting device including the driving circuit implemented by the technology according to the invention have a high efficiency and a low cost due to the use of the single stage converter. The driving circuit has a relatively high power factor with respect to the AC mains or the CCG power supply, and also has a good compatibility with the ECG and a good LED current tolerance. Further, since the single stage converter in the driving circuit may be any one of the buck converter, the buck-boost converter and the boost converter, the driving circuit has a flexible topology structure.

BRIEF DESCRIPTION OF THE DRAWINGS

The forgoing and other objects, characteristics and advantages of the invention will be more easily understood with reference to the explanation of the embodiments of the invention given blow in conjunction with the drawings. In the drawings, identical or corresponding technical features or components will be denoted by identical or corresponding reference numbers.

DETAILED DESCRIPTION OF THE INVENTION

Figure 1:
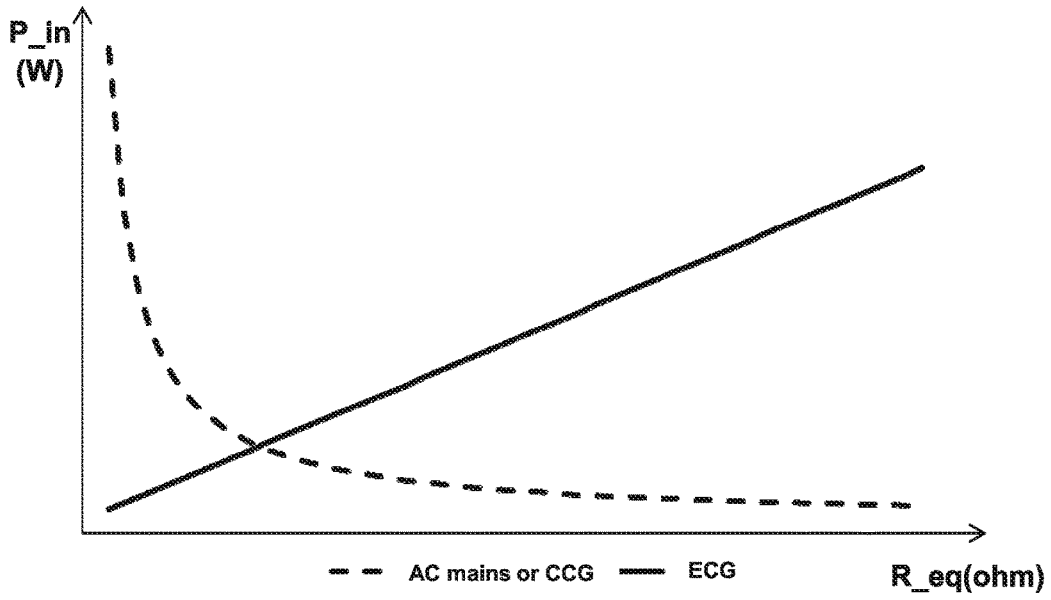
FIG. 1 is a graph illustrating a relationship between an equivalent input impedance and an input power of the driving circuit in a case that the LED driving circuit is powered by the AC mains or CCG and powered by the ECG.

Hereinafter, the invention will be described with reference to the block diagrams, circuit diagrams or the like of the device according to embodiments of the invention. It is to be noted that for the sake of clarity, illustrations and descriptions for components and processes which are less-related to the invention and known to those ordinarily skilled in the art will be omitted in the drawings and descriptions. The terms used herein are merely used to describe specific embodiments and are not intended to limit the invention.

First, a general relationship between the equivalent input impedance and the input power of the LED driving circuit will be briefly described. FIG. 1 is a graph illustrating a relationship between an equivalent input impedance and an input power of the driving circuit in a case that the LED driving circuit is powered by the AC mains or CCG and powered by the ECG.

Specifically, the AC mains and the CCG may be approximately considered as low frequency constant voltage sources (a RMS value of an output voltage thereof is constant), while most ECGs may be approximately considered as high frequency constant current sources (a RMS value of an output current thereof is constant).

As shown by the dotted line in FIG. 1, in a case that the driving circuit is powered by the AC mains or the CCG, a power P_in transferred to the driving circuit may be calculated by the following formula (1):

$$P_in = U*U/R_eq \quad (1)$$

where U is a mean value of the output voltage of the AC mains or the CCG after full-wave rectification, and R_eq is the equivalent input impedance of the driving circuit.

As shown by the solid line in FIG. 1, in a case that the driving circuit is powered by the ECG, the power P_in transferred to the driving circuit may be calculated by the following formula (2):

$$P_in = I*I*R_eq \quad (2)$$

where I is a RMS value of the output current of the ECG, and R_eq is the equivalent input impedance of the driving circuit.

As can be seen from FIG. 1, to enable a driving circuit to be compatible with the AC mains, the CCG and the ECG, it is required to design the driving circuit with different control logics for the case that the driving circuit is powered by the AC mains or the CCG and for the case that the driving circuit is powered by the ECG.

Figure 2:
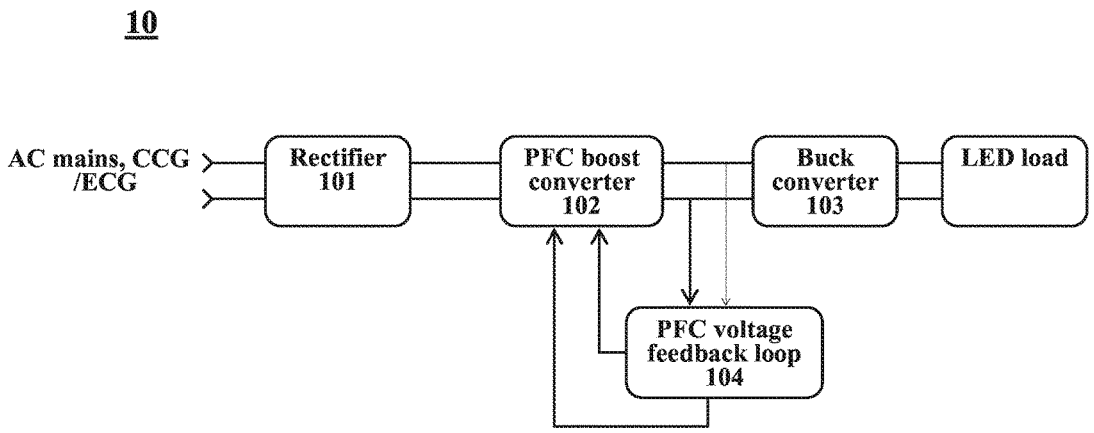
FIG. 2 is a schematic block diagram illustrating a driving circuit having two-stage converter in the prior art.

Prior to describing the specific embodiments of the invention, the driving circuit using two-stage converter so as to be compatible with the AC mains, the CCG or the ECG in the prior art will be described first. FIG. 2 is a schematic block diagram illustrating a driving circuit 10 having two-stage converter in the prior art. The driving circuit 10 may include a rectifier 101, a PFC boost converter 102, a buck converter 103 and a PFC voltage feedback loop 104.

Values of an output voltage Vout of the PFC boost converter 102 are significantly different between powering using the AC mains or the CCG and powering using the ECG. When powering using the AC mains or the CCG, the value of the output voltage Vout of the PFC boost converter 102 is about 400V; while powering using the ECG, the value of the output voltage Vout is about 190V. Therefore, depending on variation in a feedback voltage and a feedback current fed back to a PFC controller of the PFC boost converter 102 via the PFC voltage feedback loop 104, which is caused by a variation in the output voltage Vout, the PFC controller may determine a type of the used power supply (the AC mains, the CCG or the ECG).

In the example as shown in FIG. 2, the driving circuit 10 is powered by the AC mains, the CCG or the ECG. The AC current is supplied to the PFC boost converter 102 after being rectified via the rectifier 101 such as a bridge type rectifier. The PFC boost converter 102 first regulates the above rectified voltage as the output voltage Vout of 192V, if succeeded, then the input of the driving circuit 10 is judged to be the ECG input. If failed, the PFC boost converter 102 regulates the above rectified voltage as the output voltage Vout of 400V, and in this case, the input of the driving circuit 10 is judged to be the AC mains or the CCG input. The buck converter 103 performs voltage reduction conversion on the voltage of the PFC boost converter 102 so as to provide the DC power suitable for a LED load.

The driving circuit 10 has a low working efficiency due to the judging manner adopted by the driving circuit 10. Further, the driving circuit 10 has a high cost due to the adoption of the two-stage converter.

The invention attempts to provide a LED driving circuit having a single stage converter and being compatible with AC mains, the CCG and the ECG.

Figure 3:
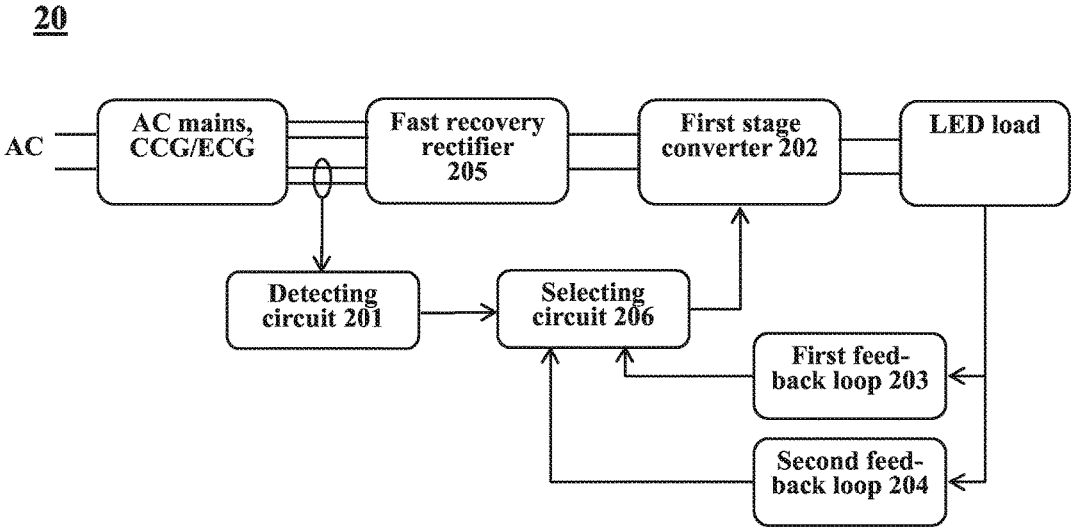
FIG. 3 is a schematic block diagram illustrating a driving circuit having a single stage converter and being compatible with the AC mains, the CCG and the ECG according to an embodiment of the invention.

FIG. 3 is a schematic block diagram illustrating a driving circuit 20 having a single stage converter and being compatible with the AC mains, the CCG and the ECG according to an embodiment of the invention.

As shown in FIG. 3, the driving circuit 20 may include a detecting circuit 201, a first stage converter 202, a first feedback loop 203 and a second feedback loop 204. Each part will be described in detail below.

Figure 4:
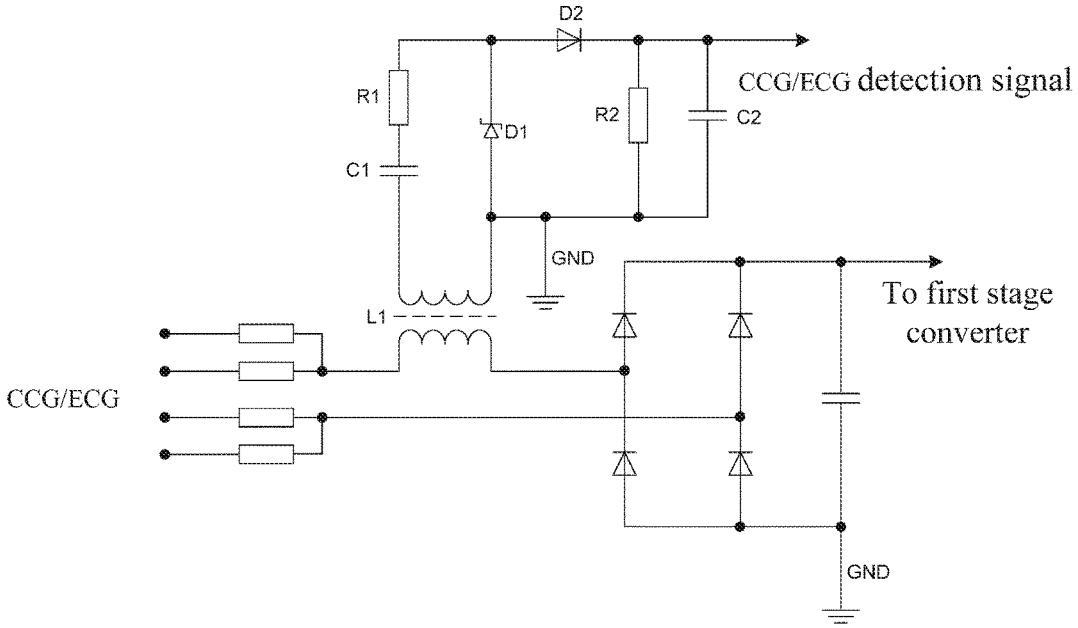
FIG. 4 is a schematic circuit diagram illustrating a detecting circuit according to an embodiment of the invention.

The detecting circuit 201 may be used to detect whether the input of the driving circuit 20 is a low frequency current or a high frequency current, wherein the low frequency current comprises output current of direct AC mains or AC mains in series with the CCG, and the high frequency current comprises output current of the ECG. Also, the detecting circuit 201 outputs a detection signal of "0" in a case that the input is detected to be the low frequency current, while outputs the detection signal of "1" in a case that the input is detected to be the high frequency current. FIG. 4 is a schematic circuit diagram illustrating the detecting circuit 201 according to an embodiment of the invention. As shown in FIG. 4, the detecting circuit 201 may include a coupling transformer L1 and a voltage stabilizing and rectifying circuit.

When an input end of the detecting circuit 201 is connected to the AC mains or the CCG, a frequency of an operating current flowing through a primary coil of the coupling transformer L1 is generally 50 Hz or 60 Hz, that is, the current flowing through the primary coil of the coupling transformer L1 is the low frequency current. When the input end of the detecting circuit 201 is connected to the ECG, the frequency of the operating current flowing through the primary coil of the coupling transformer L1 is generally 30 KHz, that is, the current flowing through the primary coil of the coupling transformer L1 is the high frequency current. The coupling transformer L1 may be configured to have a predetermined inductance so that when the low frequency current flows through the primary coil of the coupling transformer L1, an inductive voltage generated by a secondary coil of the coupling transformer L1 is an alternating voltage of 0V and when the high frequency current flows through the primary coil of the coupling transformer L1, the inductive voltage generated by the secondary coil of the coupling transformer L1 is an alternating voltage of larger than 0V.

As shown in FIG. 4, resistors R1 and R2, capacitors C1 and C2 and diodes D1 and D2 may constitute a voltage stabilizing and rectifying circuit. The current can flow through C1, R1 and D2 to charge C2 only when the alternating voltage generated by the secondary coil of the coupling transformer L1 is larger than 0V. That is to say, the detection signal having a value of "0" is output when the input is detected to be the low frequency current, while the detection signal having a value of "1" is output when the input is detected to be the high frequency current. Particularly, C2 may be a filtering capacitor which functions as stabilizing a voltage across the two ends thereof. D1 may be Zener diode which functions as voltage limiting.

Figure 5:
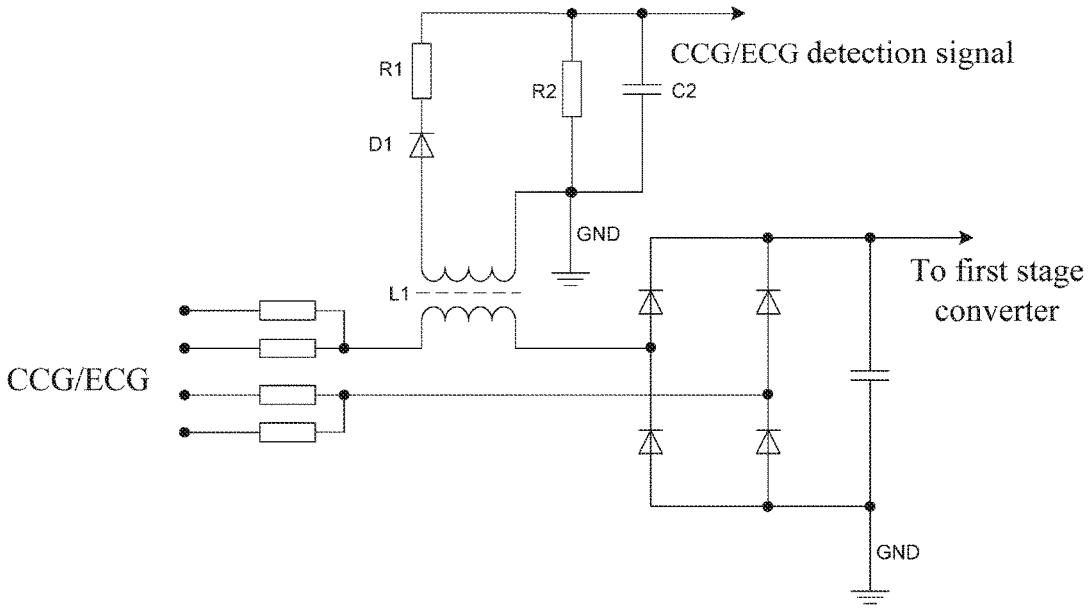
FIG. 5 is a schematic circuit diagram illustrating a detecting circuit according to another embodiment of the invention.

FIG. 5 is a schematic circuit diagram illustrating the detecting circuit 201 according to another embodiment of the invention. FIG. 5 differs from FIG. 4 only in the constitution of the voltage stabilizing and rectifying circuit, and thus description of the repeated portions will be omitted herein.

As shown in FIG. 5, the resistors R1 and R2, the diode D1 and the capacitor C2 may constitute the voltage stabilizing and rectifying circuit. The current can flow through D1 and R1 to charge C2 only when the alternating voltage generated by the secondary coil of the coupling transformer L1 is larger than 0V. That is to say, the detection signal having a value of "0" is output when the input is detected to be the low frequency current, while the detection signal having a value of "1" is output when the input is detected to be the high frequency current.

Returning to FIG. 3, the first stage converter 202 according to an embodiment of the invention may convert the input of the driving circuit 20 so as to provide the DC power suitable for the LED. The first stage converter 202 may be any one of the buck converter, the buck-boost converter and the boost converter.

The first feedback loop 203 may be activated when the detecting circuit 201 detects that the input of the driving circuit 20 is the low frequency current, to convert a current I_LED from the LED load to a feedback voltage V_feedback and feed it back to the first stage converter 202. In the first feedback loop 203, when the current I_LED of the LED load is larger than a target value, the feedback voltage V_feedback decreases, and when the current I_LED of the LED load is smaller than the target value, the feedback voltage V_feedback increases.

The second feedback loop 204 may be activated when the detecting circuit 201 detects that the input of the driving circuit 20 is the high frequency current, to convert the current I_LED from the LED load to the feedback voltage V_feedback and feed it back to the first stage converter 202. In the second feedback loop 204, when the current I_LED of the LED load is larger than the target value, the feedback voltage V_feedback increases, and when the current I_LED of the LED load is smaller than the target value, the feedback voltage V_feedback decreases.

Particularly, the target value is the current to enable the LED load to operate normally.

Figure 6:
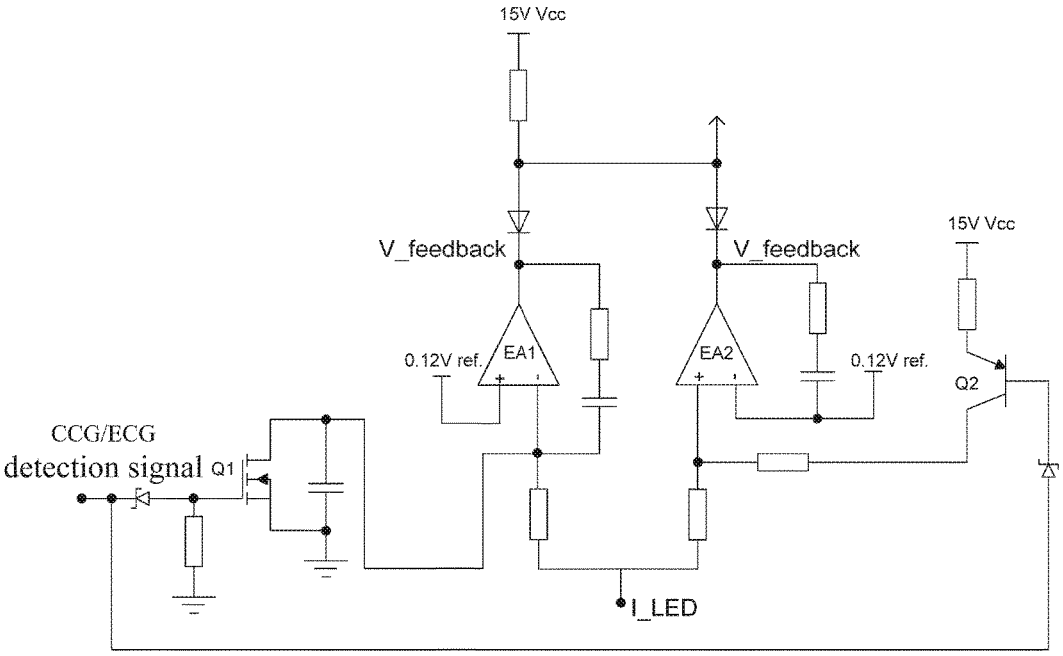
FIG. 6 is a schematic circuit diagram illustrating a first feedback loop and a second feedback loop according to an embodiment of the invention.

FIG. 6 is a schematic circuit diagram illustrating the first feedback loop 203 and the second feedback loop 204 according to an embodiment of the invention.

As shown in FIG. 6, the first feedback loop 203 may include an inverting amplifier EA1, and the second feedback loop 204 may include a non-inverting amplifier EA2.

In a case that the detecting circuit 201 detects that the input of the driving circuit 20 is the low frequency current (that is, when the detection signal is "0"), a switch transistor Q1 turns off and a switch transistor Q2 turns on, and a voltage at a non-inverting input end of the non-inverting amplifier EA2 is higher than a reference voltage at its inverting input end, and thus, an output of the non-inverting amplifier EA2 is high and may not influence the feedback voltage V_feedback. As such, the feedback voltage V_feedback is regulated by the inverting amplifier EA1. That is, when the detection signal is "0", the first feedback loop 203 is activated. The first feedback loop 203 converts the current I_LED of the LED load to the feedback voltage V_feedback and feeds it back to the first stage converter 202. The inverting amplifier EA1 makes that when the current I_LED of the LED load is larger than the target value, the feedback voltage V_feedback decreases and vice versa. The first feedback loop 203 may further include a resistor, diodes, capacitors and the like, and detailed description thereof will be omitted herein.

In a case that the detecting circuit 201 detects that the input of the driving circuit 20 is the high frequency current (that is, when the detection signal is "1"), the switch transistor Q1 turns on and the switch transistor Q2 turns off, and a voltage at a inverting input end of the inverting amplifier EA1 is lower than a reference voltage at its non-inverting input end, and thus, an output of the inverting amplifier EA1 is high and may not influence the feedback voltage V_feedback. As such, the feedback voltage V_feedback is regulated by the non-inverting amplifier EA2. That is, when the detection signal is "1", the second feedback loop 204 is activated. The second feedback loop 204 converts the current I_LED of the LED load to the feedback voltage V_feedback and feeds it back to the first stage converter 202. The non-inverting amplifier EA2 makes that when the current I_LED of the LED load is larger than the target value, the feedback voltage V_feedback increases and vice versa. The second feedback loop 204 may further include resistors, diodes, capacitors and the like, and detailed description thereof will be omitted herein.

Next, a control logic used for the first control loop 203 and a control logic used for the second control loop 204 will be described respectively in combination with the first stage converter 202.

The first stage converter 202 may include a controller and a converter switch. The controller may receive the feedback voltage V_feedback of the first feedback loop 203 or the second feedback loop 204 as input voltage. The controller may be various control chips. A turn-on time Ton of the converter switch is controlled by the input voltage of the controller. Particularly, the larger the input voltage of the controller is, the larger the turn-on time Ton of the converter switch is. As an example but not limitation, the converter switch may be a metal oxide field effect MOS transistor.

Figure 7:
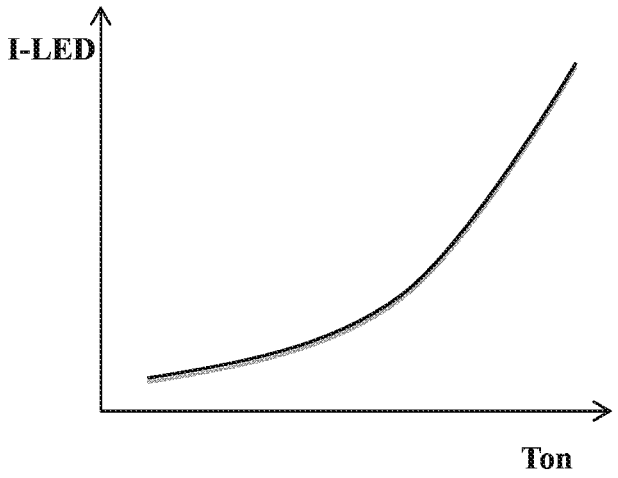
FIG. 7 is a schematic diagram illustrating a control logic used for the first feedback loop according to an embodiment of the invention.
Figure 8:
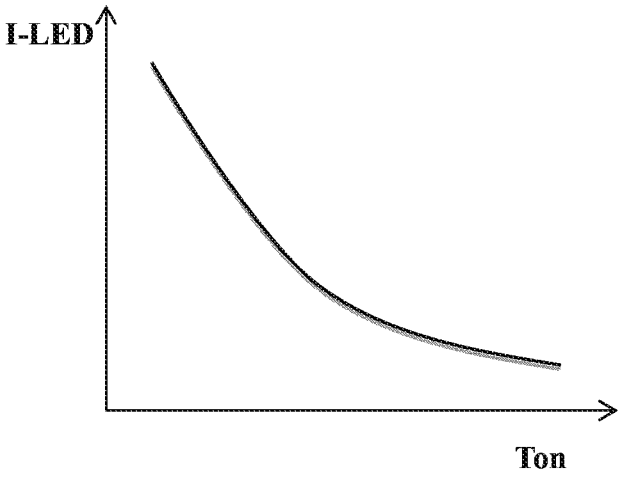
FIG. 8 is a schematic diagram illustrating a control logic used for the second feedback loop according to an embodiment of the invention.

Regarding the turn-on time Ton of the converter switch and the current I_LED of the LED load, the control logic used for the first feedback loop 203 and the control logic used for the second feedback loop 204 can be represented by FIGS. 7 and 8 respectively.

As described above, in the first feedback loop 203, when the current I_LED of the LED load is larger than the target value, the feedback voltage V_feedback decreases and vice versa, while in the second feedback loop 204, when the current I_LED of the LED load is larger than the target value, the feedback voltage V_feedback increases and vice versa.

In a case that the detecting circuit 201 detects that the input of the driving circuit 20 is the AC mains or the CCG (that is, in a case that the input is a constant voltage source), if the current I_LED of the LED load is larger than the target value, the first feedback loop 203 causes the feedback voltage V_feedback to decrease, and the turn-on time Ton of the converter switch also decreases by being controlled by the feedback voltage V_feedback, thus the current I_LED of the LED load decreases. That is to say, as shown in FIG. 7, in a case that the input of the driving circuit 20 is the AC mains or the CCG, if the current I_LED of the LED load is larger than the target value, the current I_LED of the LED load is reduced by decreasing the turn-on time Ton of the converter switch by using the first feedback loop 203.

In a case that the detecting circuit 201 detects that the input of the driving circuit 20 is the ECG (that is, in a case that the input is a constant current source), if the current I_LED of the LED load is larger than the target value, the second feedback loop 204 causes the feedback voltage V_feedback to increase, and the turn-on time Ton of the converter switch also increases by being controlled by the feedback voltage V_feedback, thus the current I_LED of the LED load decreases. That is to say, as shown in FIG. 8, in a case that the input of the driving circuit 20 is the ECG, if the current I_LED of the LED load is larger than the target value, the current I_LED of the LED load is reduced by increasing the turn-on time Ton of the converter switch by using the second feedback loop 204.

As described above, the above different control logics used for the first feedback loop 203 and the second feedback loop 204 enable the driving circuit 20 having the single stage converter (the first converter 202) to be compatible with the AC mains, the CCG and the ECG.

Further, according to another embodiment, preferably, the driving circuit 20 may further include a fast recovery rectifier 205 which may convert the input of the driving circuit 20 from the AC power to the DC power before the first stage converter 202 converts the input of the driving circuit. An an example but not limitation, the fast recovery rectifier 205 may be a bridge type rectifier.

According to another embodiment, preferably, the driving circuit 20 may further include analog filament resistors which may regulate 4-line output of the ECG into 2-line output and connect the 2-line output to the fast recovery rectifier 205. The analog filament resistors are used for ensuring the normal operation of the ECG. The analog filament resistors may comprise the resistors shown in the left of FIG. 5.

According to another embodiment, preferably, the driving circuit 20 may further include a selecting circuit 206 which may select the first feedback loop 203 or the second feedback loop 204 to be activated based on a detection result of the detecting circuit 201. As shown in FIG. 6, the selecting circuit 206 may include a switch transistor Q1 and a switch transistor Q2. In a case that the detecting circuit 201 detects that the input of the driving circuit 20 is the low frequency current (that is, when the detection signal is "0"), the switch transistor Q1 turns off and the switch transistor Q2 turns on, and the selecting circuit 206 activates the first feedback loop 203. In a case that the detecting circuit 201 detects that the input of the driving circuit 20 is the high frequency current (that is, when the detection signal is "1"), the switch transistor Q1 turns on and the switch transistor Q2 turns off, and the selecting circuit 206 activates the second feedback loop 204. As an example but not limitation, the switch transistors Q1 and Q2 may be metal oxide field effect MOS transistors. The selecting circuit 206 is not necessary, and those skilled in the art may readily conceive of other ways to activate the first feedback loop 203 or the second feedback loop 204.

As can be seen from simulation experiments, for different ECG inputs, the driving circuit 20 may provide the DC power suitable for the LED, that is to say, the driving circuit 20 may have good ECG compatibility.

According to another embodiment, the driving circuit according to the embodiment of the invention may further include a second stage converter.

Figure 9:
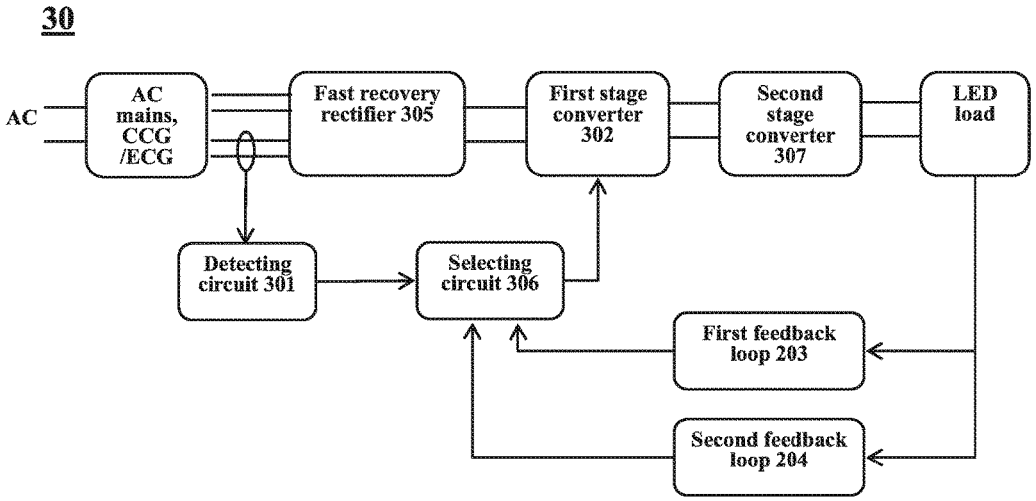
FIG. 9 is a schematic block diagram illustrating a driving circuit having two-stage converter according to an embodiment of the invention.

FIG. 9 is a schematic block diagram illustrating a driving circuit 30 having two-stage converter according to an embodiment of the invention. FIG. 9 differs from FIG. 3 only in that the driving circuit 30 further includes a second stage converter 307, and description of the repeated portions will be omitted herein.

The second stage converter 307 is a buck converter connected between a first stage converter 302 and the LED load, and is used to reduce an output voltage of the first stage converter 302, smooth ripple of the output voltage and output the processed voltage to the LED load. Particularly, the second stage converter 307 is a buck converter with fixed turn-on time. Due to the introduction of the second stage converter 307 as the buck converter, the driving circuit 30 has a good ripple suppressing property.

The LED driving circuit and the LED lighting device including the driving circuit according to the embodiments of the invention have a high efficiency and a low cost due to the adoption of the single stage converter. This driving circuit has a relatively high power factor with respect to the AC mains or the CCG power supply, and also has a good ECG compatibility and good LED current tolerance. Furthermore, the single stage converter in the driving circuit may be any one of the buck converter, the buck-boost converter and the boost converter, and thus the driving circuit has a flexible topology structure.

The invention has been described with reference to the specific embodiments in the forgoing specification. However, those ordinarily skilled in the art may understand that various modifications and changes may be made without departing from the scope of the invention as defined in the claims.

The invention claimed is:

1. A light emitting diode (LED) driving circuit comprising:

a detecting circuit that detects whether an input of the driving circuit is a low frequency current or a high frequency current;

a first stage converter that converts the input of the driving circuit in providing a DC power for a light-emitting diode (LED) load coupled with the LED driving circuit;

a first feedback loop that converts a current from the LED load to a feedback voltage and feeds that feedback voltage back to the first stage converter when the detecting circuit detects that the input of the driving circuit is the low frequency current, wherein in the first feedback loop:

when the current of the LED load is larger than a target value, the feedback voltage decreases; and when the current of the LED load is smaller than the target value, the feedback voltage increases; and a second feedback loop that converts the current from the LED load to the feedback voltage and feeds that feedback voltage back to the first stage converter when the detecting circuit detects that the input of the driving circuit is the high frequency current, wherein in the second feedback loop:

when the current of the LED load is larger than the target value, the feedback voltage increases; and when the current of the LED load is smaller than the target value, the feedback voltage decreases.

2. The driving circuit according to claim 1, wherein:

the low frequency current comprises output current of direct AC mains or AC mains in series with a conventional ballast; and the high frequency current comprises output current of an electronic ballast.

3. The driving circuit according to claim 1, wherein the first stage converter comprises:

a controller that receives the feedback voltage of the first feedback loop or the second feedback loop as an input voltage; and a converter switch, a turn-on time of which is controlled by the input voltage of the controller, wherein the larger the input voltage of the controller is, the larger the turn-on time of the converter switch is.

4. The driving circuit according to claim 1, wherein the detecting circuit comprises a coupling transformer configured to have a predetermined inductance so that:

when the low frequency current flows through a primary coil of the coupling transformer, an inductive voltage generated by a secondary coil of the coupling transformer is an alternating voltage of 0V; and when the high frequency current flows through the primary coil of the coupling transformer, the inductive voltage generated by the secondary coil of the coupling transformer is an alternating voltage of larger than 0V.

5. The driving circuit according to claim 1, wherein the first feedback loop comprises an inverting amplifier.

6. The driving circuit according to claim 1, wherein the second feedback loop comprises a non-inverting amplifier.

7. The driving circuit according to claim 1, wherein the first stage converter is any one of a buck converter, a buck-boost converter, and a boost converter.

8. The driving circuit according to claim 1, wherein the driving circuit further comprises a fast recovery rectifier that converts the input of the driving circuit from the AC power to the DC power before the first stage converter converts the input of the driving circuit.

9. The driving circuit according to claim 1, wherein the driving circuit further comprises a selecting circuit that selects the first feedback loop or the second feedback loop to be activated based on a detection result of the detecting circuit.

10. The driving circuit according to claim 1, wherein the driving circuit further comprises a second stage converter, which is a buck converter connected between the first stage converter and the LED load, that reduces an output voltage of the first stage converter, smooths ripple of the output voltage, and outputs the processed voltage to the LED load.

11. A lighting device comprising:

a light emitting diode (LED) driving circuit comprising:

a detecting circuit that detects whether an input of the driving circuit is a low frequency current or a high frequency current;

a first stage converter that converts the input of the driving circuit in providing a DC power for a light-emitting diode (LED) load coupled with the LED driving circuit;

a first feedback loop that converts a current from the LED load to a feedback voltage and feeds that feedback voltage back to the first stage converter when the detecting circuit detects that the input of the driving circuit is the low frequency current, wherein in the first feedback loop:

when the current of the LED load is larger than a target value, the feedback voltage decreases; and when the current of the LED load is smaller than the target value, the feedback voltage increases; and a second feedback loop that converts the current from the LED load to the feedback voltage and feeds that feedback voltage back to the first stage converter when the detecting circuit detects that the input of the driving circuit is the high frequency current, wherein in the second feedback loop:

when the current of the LED load is larger than the target value, the feedback voltage increases; and when the current of the LED load is smaller than the target value, the feedback voltage decreases; and at least one light emitting diode (LED) communicatively coupled with the driving circuit.

12. The driving circuit according to claim 1, wherein the driving circuit is compatible with each of AC mains, CCG, and ECG inputs.

13. The driving circuit according to claim 1, wherein the target value is the current to enable the LED load to operate normally.

14. The driving circuit according to claim 1, wherein:

the first feedback loop comprises an inverting amplifier; and the second feedback loop comprises a non-inverting amplifier.

15. The driving circuit according to claim 1, wherein the driving circuit further comprises a second stage converter connected between the first stage converter and the LED load.

16. The driving circuit according to claim 15, wherein the second stage converter is configured to:

at least one of reduce an output voltage of the first stage converter and smooth ripple of the output voltage; and output the processed voltage to the LED load.

17. The driving circuit according to claim 15, wherein the second stage converter is configured as a buck converter.

18. The driving circuit according to claim 17, wherein the buck converter has a fixed turn-on time.

19. The driving circuit according to claim 1, wherein the driving circuit operates based on:

a first control logic for instances in which the driving circuit is powered by AC mains or CCG; and a second control logic for instances in which the driving circuit is powered by ECG.

20. The driving circuit according to claim 19, wherein:

with the first control logic, a turn-on time of a converter switch of the first stage converter increases as a current from the LED load increases; and with the second control logic, a turn-on time of a converter switch of the first stage converter decreases as a current of the LED load decreases.

* * * * *